US009388709B2

(12) United States Patent
Edwards

(10) Patent No.: US 9,388,709 B2
(45) Date of Patent: Jul. 12, 2016

(54) GAS TURBINE ROTOR AND EXHAUST MAINTENANCE SKID

(71) Applicant: Siemens Energy, Inc., Orlando, FL (US)

(72) Inventor: James B. Edwards, Sanford, FL (US)

(73) Assignee: Siemens Energy, Inc., Orlando, FL (US)

( * ) Notice: Subject to any disclaimer, the term of this patent is extended or adjusted under 35 U.S.C. 154(b) by 25 days.

(21) Appl. No.: 14/460,681

(22) Filed: Aug. 15, 2014

(65) Prior Publication Data

US 2016/0047278 A1 Feb. 18, 2016

(51) Int. Cl.
*F16M 13/00* (2006.01)
*F01D 25/28* (2006.01)

(52) U.S. Cl.
CPC ..... *F01D 25/285* (2013.01)

(58) Field of Classification Search
CPC ..... F01D 25/285; F16M 1/04; F16M 11/04; F16M 11/06; F16M 11/08; F16M 11/10; F16M 11/105; F16M 11/12; F01L 3/16
USPC ..... 248/542, 543, 652, 666
See application file for complete search history.

(56) References Cited

U.S. PATENT DOCUMENTS 8,826,520 B1 * 9/2014 Spanos ..... B23P 19/025 29/596
2003/0014961 A1 * 1/2003 Lawlor ..... F01D 1/04 60/39.35
2008/0264061 A1 * 10/2008 Wickert ..... F04D 25/16 60/670
2010/0218508 A1 * 9/2010 Brown ..... F16M 5/00 60/796
2015/0184591 A1 * 7/2015 Giancotti ..... F01D 25/28 60/798
2015/0207380 A1 * 7/2015 Taketomi ..... F04B 39/0044 310/91
2015/0316197 A1 * 11/2015 Morey ..... F16M 1/04 280/30

* cited by examiner

*Primary Examiner* — Mark Wendell

(57) ABSTRACT

A system and method for maintenance and inspection of a rotor and exhaust assembly that includes a maintenance skid. The maintenance skid includes an exhaust portion that holds an exhaust and a rotor portion that holds a rotor. A pair of movable stands are part of the exhaust portion, where the movable stands move along tracks. At least two stands are part of the rotor portion, where the stands include rollers that allow the rotor to be turned.

13 Claims, 4 Drawing Sheets

GAS TURBINE ROTOR AND EXHAUST MAINTENANCE SKID

BACKGROUND OF THE INVENTION

1. Field of the Invention

This invention relates generally to a system and method for gas turbine rotor and exhaust maintenance and, more particularly, to a system and method for disassembling and reassembling a unified rotor and single piece exhaust assembly by providing a gas turbine rotor and exhaust assembly maintenance skid system that includes movable stands that allow the exhaust portion to be removed from the rotor and rollers that allow the rotor to be turned.

2. Discussion of the Related Art

The world's energy needs continue to rise which provides a demand for reliable, affordable, efficient and environmentally-compatible power generation. A gas turbine engine is one known machine that provides efficient power, and common applications are an electric generator in a power plant or engines for aircraft and ships. A typical gas turbine engine includes a compressor section, a combustion section and a turbine section. The compressor section provides a compressed air flow to the combustion section where the air is mixed with a fuel, such as natural gas, and ignited to create a hot working gas. The working gas expands through the turbine section and is directed across rows of blades therein by associated vanes. As the working gas passes through the turbine section, it causes the blades to rotate, which in turn causes a shaft to rotate, thereby providing mechanical work.

The temperature of the working gas is tightly controlled so that it does not exceed some predetermined temperature for a particular turbine engine design because too high of a temperature can damage various parts and components in the turbine section of the engine. However, it is desirable to allow the temperature of the working gas to be as high as possible because the higher the temperature of the working gas, the faster the flow of the gas, which results in a more efficient operation of the engine.

A single piece exhaust (SPEX) for a gas turbine engine has been in production for several years for certain types of turbine engines. Previous configurations included a horizontally split exhaust cylinder that allowed for the removal of the rotor of the turbine engine separate from the removal of the exhaust cylinder. With the SPEX design, the rotor and SPEX are removed together as an assembly. The rotor and SPEX may need to be removed for various reasons, including major inspections and/or repairs. The estimated size of a crane that is necessary to lift the rotor and SPEX assembly ranges from 550 to 650 ton, and possibly as high as 800 ton, depending on the site arrangement. Rental rates for such cranes may be in the range of $13,500 per day to $18,700 per day. The personnel cost for a typical major inspection when using a crane is approximately $70,000 per day. Because of the cost and time investment with using a crane to support the rotor and SPEX assembly during an inspection and/or repairs, there is a need in the art to be able to perform disassembly and reassembly of a rotor and SPEX assembly in a more cost effective manner.

SUMMARY OF THE INVENTION

This disclosure describes a system and method for maintenance and inspection of a rotor and exhaust assembly that includes a maintenance skid. The maintenance skid includes an exhaust portion that holds an exhaust and a rotor portion that holds a rotor. A pair of movable stands are part of the exhaust portion, where the movable stands move along tracks.

At least two stands are part of the rotor portion, where the stands include rollers that allow the rotor to be turned.

Additional features of the present invention will become apparent from the following description and appended claims, taken in conjunction with the accompanying drawings.

DETAILED DESCRIPTION OF THE EMBODIMENTS

The following discussion of the embodiments of the invention directed to a gas turbine rotor and exhaust maintenance skid system is merely exemplary in nature, and is in no way intended to limit the invention or its applications or uses.

Figure 1:
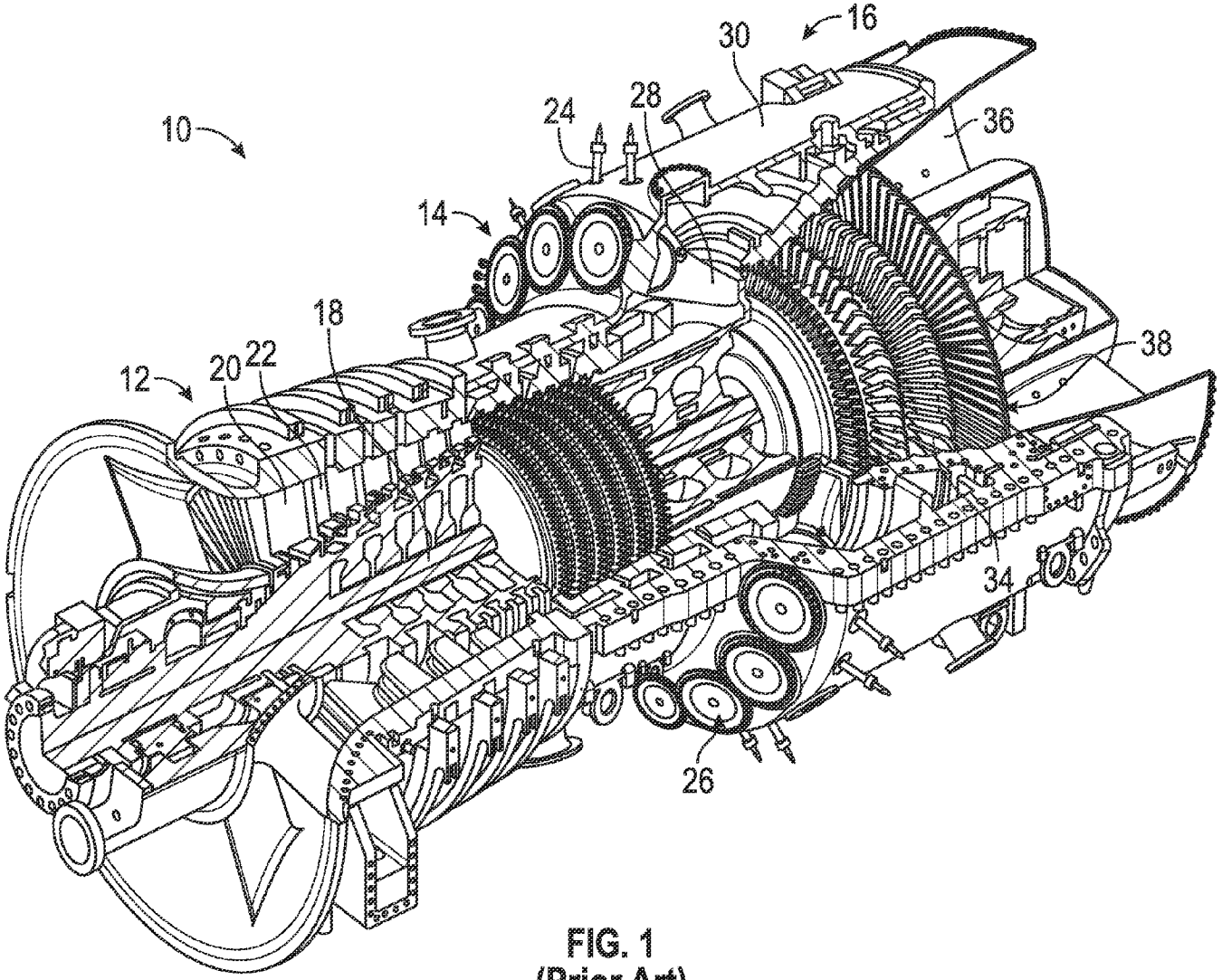
FIG. 1 (Prior Art)
FIG. 1 is a cut-away, isometric view of a gas turbine engine.

FIG. 1 is a cut-away, isometric view of a gas turbine engine 10 including a compressor section 12, a combustion section 14 and a turbine section 16 all enclosed within an outer housing 30, where operation of the engine 10 causes a central shaft or rotor 18 to rotate, thus creating mechanical work. The engine 10 is illustrated and described by way of a non-limiting example to give context to the invention discussed below. Those skilled in the art will appreciate that other gas turbine engine designs will also benefit from the invention. Rotation of the rotor 18 draws air into the compressor section 12 where it is directed by vanes 22 and compressed by rotating blades 20 to be delivered to the combustion section 14 where the compressed air is mixed with a fuel, such as natural gas, and where the fuel/air mixture is ignited to create a hot working gas. More specifically, the combustion section 14 includes a number of circumferentially disposed combustors 26 each receiving the fuel that is injected into the combustor 26 by an injector (not shown) and mixed with the compressed air to be ignited by an igniter 24 to create the working gas, which is directed by a transition 28 into the turbine section 16. The working gas is directed by circumferentially disposed stationary vanes (not shown) in the turbine section 16 to flow across circumferentially disposed rotatable turbine blades 34, which causes the turbine blades 34 to rotate, thus rotating the rotor 18. Once the working gas passes through the turbine section 16 it is output from the engine 10 as an exhaust gas through an output nozzle 36.

Each group of the circumferentially disposed stationary vanes defines a row of the vanes and each group of the circumferentially disposed blades 34 defines a row 38 of the blades 34. In this non-limiting embodiment, the turbine section 16 includes four rows 38 of the rotating blades 34 and four rows of the stationary vanes in an alternating sequence. In other gas turbine engine designs, the turbine section 16 may include more or less rows of the turbine blades 34. The blades 34 sit in grooves on the rotor 18 and are locked into place, as is known to those skilled in the art.

Figure 2:
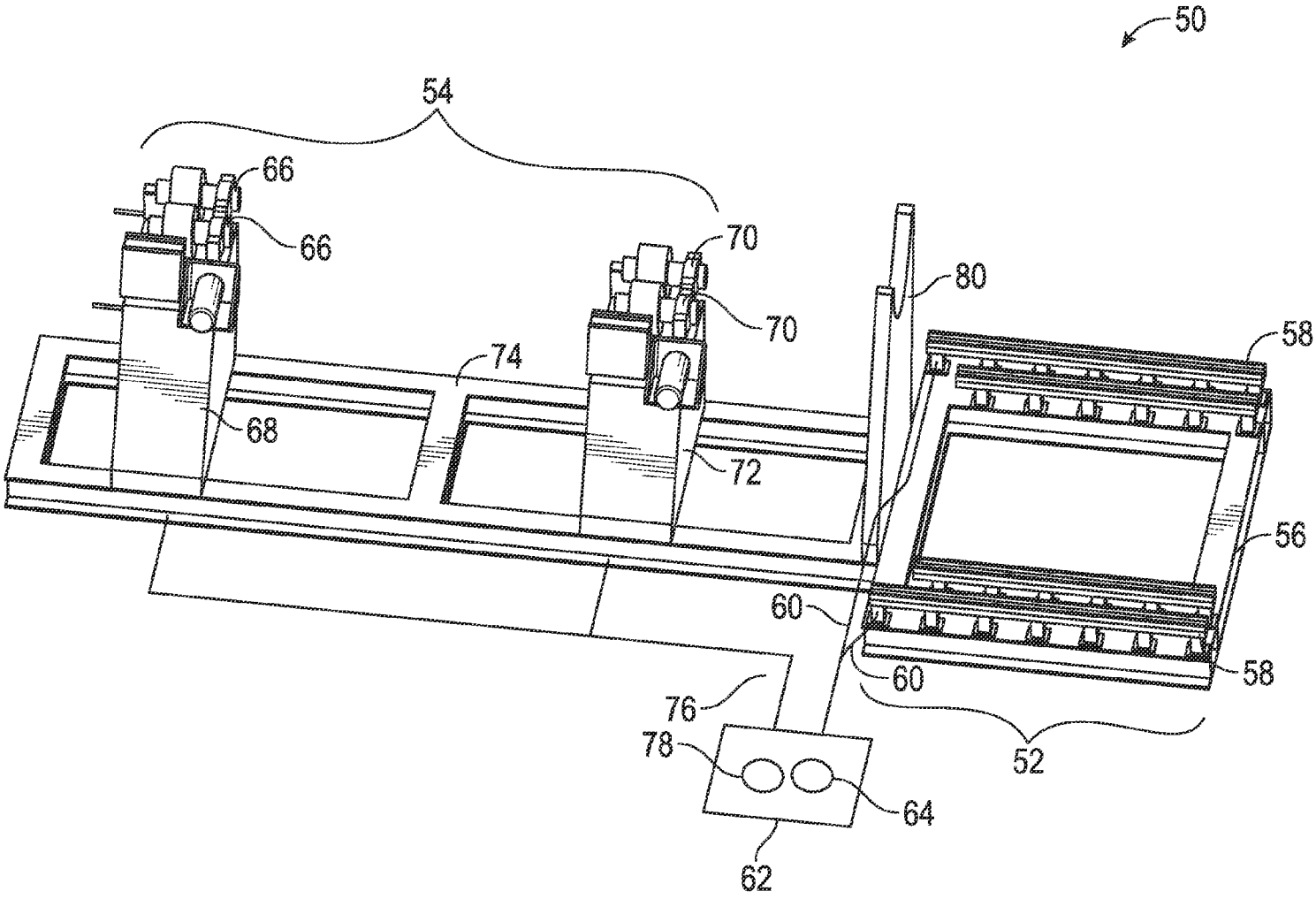
FIG. 2 is an illustration of a gas turbine rotor and exhaust maintenance skid system.

FIG. 2 is an illustration of a gas turbine rotor and exhaust maintenance skid system 50 that includes mechanisms for allowing a rotor and single piece exhaust assembly to be turned while on the system 50 as is described in more detail below. Known systems use static rotor stands that do not allow the rotor to turn while in the static rotor stands, thus requiring the time and cost associated with using a crane as discussed above. The maintenance skid system 50 includes an exhaust end portion 52 and a rotor end portion 54. The exhaust end portion 52 includes a platform 56 with tracks 58 that are used to disassemble/reassemble an exhaust of a rotor and single piece exhaust (SPEX) assembly as described in detail below. Electric and/or hydraulic lines 60 are used to axially move a stand (not shown) that is on the tracks 58 using a switch, lever, knob or similar mechanism 64 of a control box 62. The rotor end portion 54 includes rollers 66 that are used to support a portion of a rotor that is resting on a stand 68, and rollers 70 are provided to support a different portion of a rotor that is resting on a stand 72. The stands 68 and 72 may be moved axially for both alignment and to accommodate different landing locations of a rotor that is being set on the stands 68 and 72. The stands 68 and 72 may also be adjusted in elevation such that the rollers 66 and 70 may be brought into alignment as desired. The rollers 66 and 70 may be operated, i.e., caused to roll, using electric and/or hydraulic lines 76 and a switch, lever, knob or similar mechanism 78 of the control box 62. The stands 68 and 72 rest on top of a platform 74. The size of the rollers 66 and 70 may vary to compliment the size of a rotor that is being set on the system 50. The rollers 66 and 70 may also be interchangeable so that a single system 50 is capable of being used with various sizes of rotors. While two of the stands 68 and 72 are shown, it is to be understood that more stands may be included in the system 50. Furthermore, while the rollers 66 and 70 are shown as power rollers, only one set of the rollers 66 or 70 may be power rollers while the other are free moving rollers.

Figure 3:
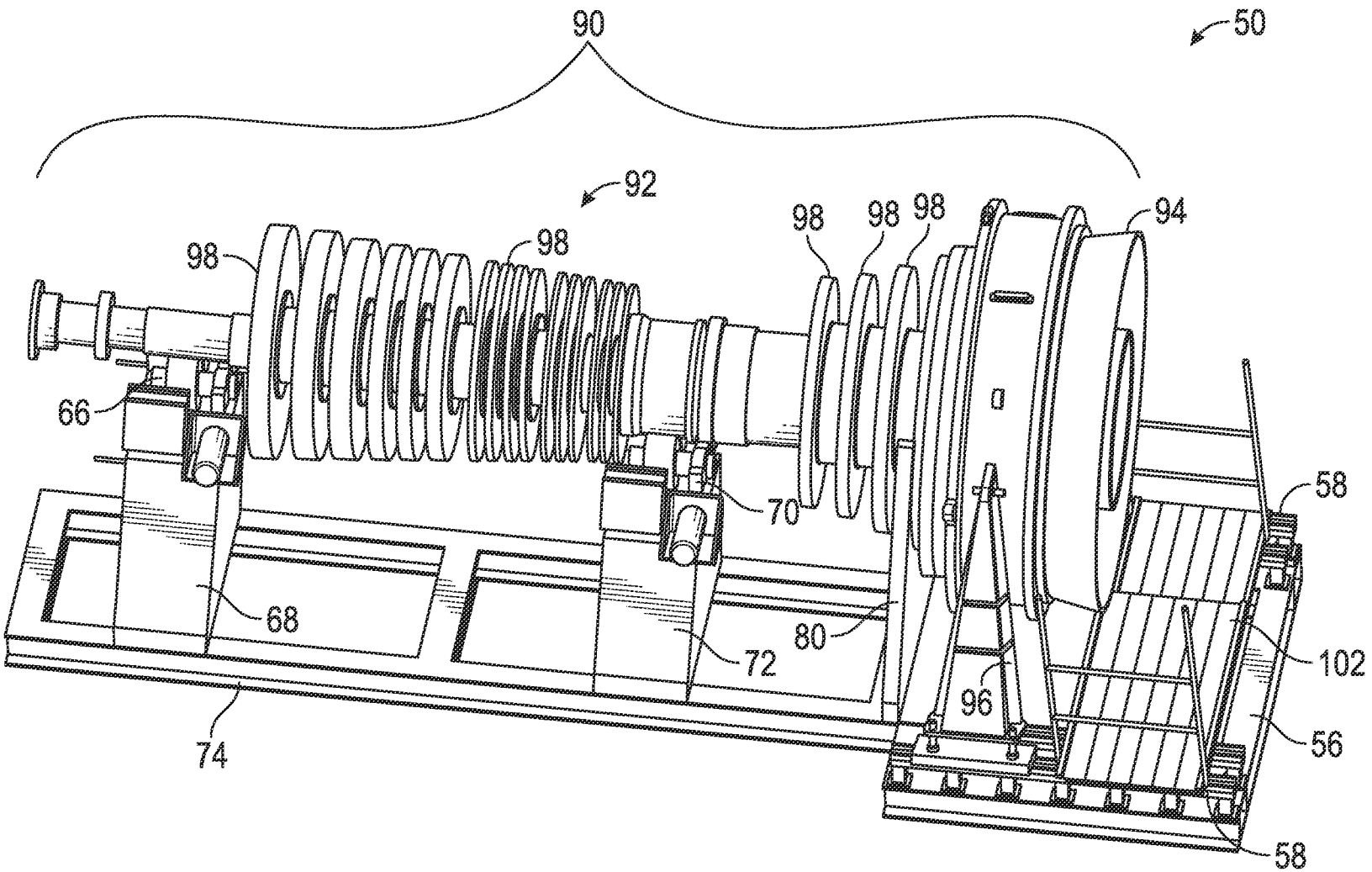
FIG. 3 is an illustration of a rotor and SPEX assembly seated on the gas turbine rotor and exhaust maintenance skid system.

FIG. 3 is an illustration of a rotor and SPEX assembly 90 seated on the gas turbine rotor and exhaust maintenance skid system 50 of FIG. 2, where the same reference numerals are used in FIG. 3 for like elements identified in FIG. 2. The rotor and SPEX assembly 90 includes a rotor 92 and an exhaust 94. As stated above, known stands for rotors do not allow the rotor to turn while it is seated in the stands, which means a crane must be used to disassemble/reassemble rotor and SPEX assemblies. A crane must further be used to remove/replace blades on the rotor. Using the system 50, the disassembly/reassembly of the rotor and SPEX assembly 90 as well as the removal/replacement of blades 98 on the rotor 92 may be achieved without requiring the use of a crane. As stated above, the stands 68 and 72 are movable such that the stands 68 and 72 may be adjusted forward, back, left, right, up, down, tilt forward, tilt back, rotate left and rotate right to facilitate holding the rotor and SPEX assembly 90 in a variety of positions during the assembly/disassembly process. For example, when removing the exhaust 94, the stands 68 and 72 may be adjusted such that the weight of the rotor 92 is not resting on the bearing housing such that the bearing housing and seal may be removed. For reinstalling the bearing housing and seal, the clearances between a bore of the exhaust 94 and the seal housing and a bearing housing are only approximately a couple of thousandths of an inch, thus alignment is critical for the components to fit together without damage. The movability of the stands 68 and 72 allows for careful alignment to occur.

To remove a bearing housing and seal of the rotor and SPEX assembly 90, a platform or scaffolding 102 is provided. The height of the platform 102 is such that a person may stand on the platform 102 and work on the bearing and seal. The platform 102 may be added and removed from the skid system 50 using, for example, a fork truck, or the platform 102 may be integrated into the skid system 50 such that it is part of the skid and is capable of raising or lowering as part of the skid. After a bearing and seal housing are removed, the exhaust 94 may be moved off the rotor 92 as described below.

Figure 4:
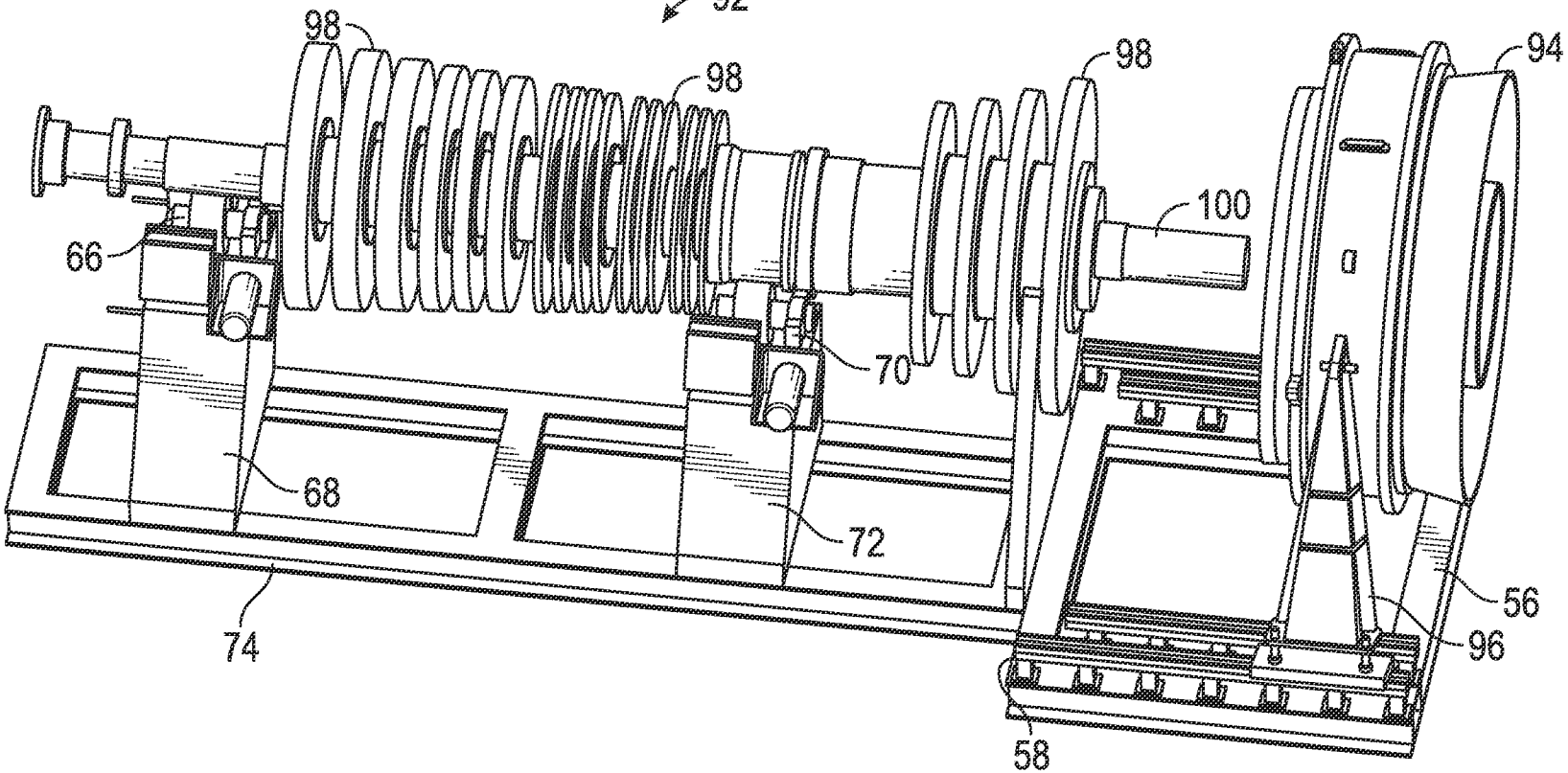
FIG. 4 is an illustration of the rotor and SPEX assembly seated on the gas turbine rotor and exhaust maintenance skid system where the SPEX has been removed from the rotor.

FIG. 4 is an illustration of the rotor and SPEX assembly 90 seated on the gas turbine rotor and exhaust maintenance skid system 50 that illustrates a rolling stand portion 96 that rolls along the track 58 to allow the exhaust 94 to move axially such that the exhaust 94 comes off an end 100 of the rotor 92. The size of the stand portion 96 may be varied to compliment the size of an exhaust that is placed in the system 50. Although not shown for the sake of clarity, each of the tracks 58 has its own stand portion 96. Rollers in the tracks 58 may be used to cause the stand portions 96 to move back and forth along the tracks 58. Alternatively, each stand portion 96 may include a motor that causes the stand portions 96 to move back and forth along the tracks 58. Once the exhaust 94 has been removed, the rotor 92 may be turned for blade removal and inspection as described below. Blades have a certain life, thus blades may need to be replaced periodically.

The rollers 66 and/or 70 are power rollers that may be operated such that the rotor 92 may be turned so that the blades 98 may be removed after the exhaust 94 has been removed off of the end 100 as described above. Once the inspection and/or maintenance work to the assembly 90 is complete, the components that were removed, e.g., the blades 98 and the exhaust 94, may be reassembled in reverse order. The system 50 provides the advantages of minimized time that the assembly 90 is not in use for power generation and also minimized use of a crane. Using the system 50 described above, a large crane is only necessary to place the assembly 90 on the system 50 and remove the assembly 90 therefrom upon completion of inspection and/or maintenance. Using the system 50, work that is done on the rotor 92 and the exhaust 94 is either self-sufficient or requires simply the use of a forklift. Estimated savings using the system 50 are a minimum of three days of time savings or between $250,000-$267,000 in cost avoidance per major inspection.

The foregoing discussion discloses and describes merely exemplary embodiments of the present invention. One skilled in the art will readily recognize from such discussion, and from the accompanying drawings and claims, that various changes, modifications and variations can be made therein without departing from the scope of the invention as defined in the following claims.

What is claimed is:

1. A gas turbine rotor and exhaust assembly maintenance system, said system comprising:

a maintenance skid configured to support the gas turbine rotor and exhaust assembly after it has been removed from a gas turbine, said maintenance skid including an exhaust portion configured to support an exhaust of the gas turbine rotor and exhaust assembly and a rotor portion configured to support a rotor of the gas turbine rotor and exhaust assembly, said exhaust portion including opposing tracks and said rotor portion including a rotor portion platform;

a pair of exhaust stands where each exhaust stand is slidably mounted to one of the tracks so as to allow the exhaust to be slidably removed from the rotor and reassembled thereto; and at least two rotor stands secured to the rotor portion platform and being configured to support the rotor, said rotor stands including rollers that are configured to allow the rotor that is seated on the rotor portion to be turned.

2. The system according to claim 1 wherein the rollers are power rollers.

3. The system according to claim 1 wherein a portion of the rollers are power rollers.

4. The system according to claim 1 wherein the exhaust stands are powered to move back and forth along the tracks.

5. The system according to claim 1 further comprising a maintenance platform that is configured to allow a person to stand on the maintenance platform and inspect or work on a bearing, seal, or a combination thereof, of the exhaust assembly.

6. The system according to claim 1 wherein the rollers are configured to be removable from the rotor stands so as to be replaceable with other rollers having other sizes.

7. The system according to claim 1 wherein the exhaust stands are configured to be replaceable with other exhaust stands having other sizes.

8. A method for providing maintenance and inspection of a rotor and exhaust assembly of a gas turbine, said method comprising:

providing a maintenance skid configured to support the rotor and exhaust assembly after it has been removed from the gas turbine, said maintenance skid including an exhaust portion configured to support an exhaust of the rotor and exhaust assembly and a rotor portion configured to support a rotor of the rotor and exhaust assembly, said exhaust portion including opposing tracks and said rotor portion including a rotor portion platform;

providing a pair of exhaust stands where each exhaust stand is slidably mounted to one of the tracks so as to allow the exhaust to be slidably removed from the rotor and reassembled thereto; and providing at least two rotor stands secured to the rotor portion platform and being configured to support the rotor, said rotor stands including rollers that are configured to allow the rotor that is seated on the rotor portion to be turned to allow blades that are part of the rotor to be removed and replaced.

9. The method according to claim 8 wherein at least a portion of the rollers are power rollers.

10. The method according to claim 8 wherein the exhaust stands are powered to move back and forth along the tracks.

11. The method according to claim 8 further comprising a maintenance platform that is configured to allow a person to stand on the maintenance platform and inspect or work on the exhaust assembly.

12. The method according to claim 8 wherein the rollers are configured to be removable from the rotor stands so as to be replaceable with other rollers having other sizes.

13. The method according to claim 8 wherein the exhaust stands are configured to be replaceable with other exhaust stands having other sizes.

* * * * *